United States Patent [19]

Goserud

[11] 4,108,413

[45] Aug. 22, 1978

[54] CLAMPING DEVICE

[76] Inventor: Dean L. Goserud, 1981 Princeton Ave., St. Paul, Minn. 55105

[21] Appl. No.: 826,042

[22] Filed: Aug. 19, 1977

[51] Int. Cl.[2] ..... A47K 1/08

[52] U.S. Cl. ..... 248/214; 248/311.1 A; 248/316 C; 24/84 H; 24/248 SA

[58] Field of Search ..... 248/205 R, 214, 226.3, 248/229, 311.1 A, 312, 313, 316 C, 318; 24/84 A, 84 H, 248 SA, 263 A

[56] References Cited

U.S. PATENT DOCUMENTS

| | | | |
|---|---|---|---|
| 510,468 | 12/1893 | Buehl | 24/84 H |
| 2,308,805 | 1/1943 | Dahl | 248/316 B X |
| 2,912,206 | 11/1959 | Ferris et al. | 248/229 |
| 2,961,693 | 11/1960 | Prehm | 248/214 X |

FOREIGN PATENT DOCUMENTS

| | | | |
|---|---|---|---|
| 1,352,955 | 1/1964 | France | 248/214 |
| 409,592 | 2/1925 | Fed. Rep. of Germany | 24/248 SA |

*Primary Examiner*—William H. Schultz

[57] ABSTRACT

A small clamp capable of gripping light or heavy containers and the like without damage to the container wall is provided, the clamp comprising a pair of opposing channel shaped elements which interact with one another to grip an object between the opposing flange edges of the lower portions of the elements. The upper end of one of the elements has an inturned projection which abuts the web of the other element adjacent its upper end and the actuating means for the clamp interconnects the elements to one another intermediate the upper end of the clamp and the gripping flanges, the effective length of the projection being such as to maintain the gripping edges of the flanges of the two clamping elements generally parallel to one another as they approach coplanarity.

11 Claims, 6 Drawing Figures

CLAMPING DEVICE

This invention relates to a clamp and clamp assembly of novel construction for holding objects in suspension above a surface.

The clamp of this invention is extremely versatile and ideally suited for suspending heavy or light, bulky or small objects alike from a supporting rail, hook, rod, or the like. Alone or when assembled into a bracket the clamps of this invention are particularly useful for suspending objects from gunwales of a boat so that the objects remain suspended above the floor or deck of the boat, where they remain dry and out of the way adjacent the inner sidewall of the boat while within ready reach of the occupants of the boat.

The construction of the clamp of the present invention is such that it can grip the wall of a container tightly and evenly along the entire gripping length of the clamp without damage to the container. This is quite important in the suspension of cans, pails and similar containers since it permits tight gripping without puncture or distortion of the container wall. Further, by virtue of the clamp construction, a pair of the clamps may be readily assembled into a bracket by interconnecting them with a connecting bar. When so assembled a rigid structure is provided that minimizes swinging motion. The clamps may also be suspended singly where desired.

While ideally suited for boating, the clamp of this invention can be used to suspend objects from walls, hooks, rods or any other support safely and securely without damage to the object being so suspended.

The clamp of this invention comprises first and second elongated clamping members or elements each having an upper portion and lower gripping portion and including generally parallel side flanges interconnected by a web, the side flanges extending at least along the lower gripping portion of each element. The second element is narrower than the first element and interfits therewith so that its side flanges are adapted to nest between the side flanges of the first element. The edges of the side flanges on the lower portions of said elements comprise the gripping surfaces for the clamp. The upper end of the first element extends above the upper end of the second element and the upper end of the web of the second element has an inwardly extending projection abutting the upper portion of the web of said first element. Actuating means for opening and closing the clamp interconnect the upper portions of said elements to one another between the projection and the lower gripping portions of the clamping elements. The projection maintains the gripping edges of the side flanges along the lower gripping portions of the clamping elements generally parallel to one another as they approach coplanarity as the clamp elements are moved from an open spaced apart object receiving position to a closed object gripping position thereby enabling the gripping edges of the clamp elements to tightly grip an object therebetween while exerting relatively even pressure along the gripping length of the flange edges.

In the accompanying drawings wherein a preferred form of the invention is illustrated:

Figure 1:
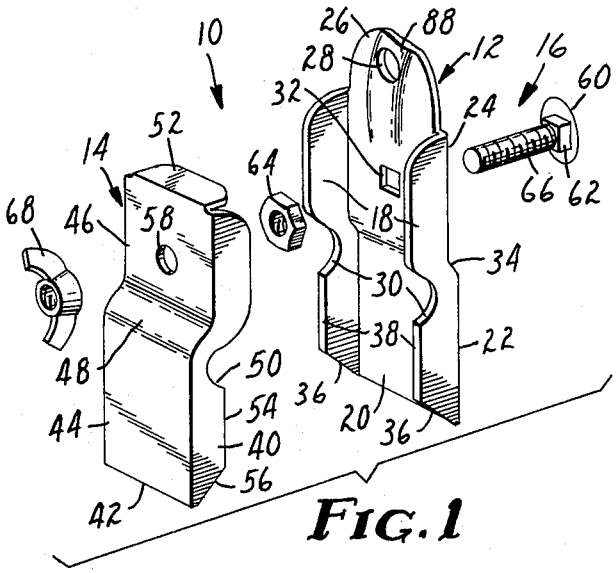
FIG. 1 is an exploded view of the clamp of the present invention.

Turning first to FIG. 1 there is illustrated a preferred form 10 of the clamp of the present invention, which clamp is designed for suspending objects from a support. Clamp 10 comprises a first clamp element 12 and a second clamp element 14 which are joined to one another by an actuating means 16 for opening and closing the clamp.

The first clamping element 12 comprises an elongated element including generally parallel side flanges 18 interconnected by a web 20. The side flanges 18 extend at least along the lower portion 22 of the element 12 which lower portion comprises the gripping portion of the element. The side flanges 18 in the version shown are seen to extend along most of the upper portion 24 of the clamping element 12 also. However, the web 20 extends above the upper ends of the side flanges 18 to provide a means 26 for suspending the element from a support. In this version of the clamp the extension has an aperture 28 therethrough for suspending the clamp from a hook, or nail, or the like. The upper end of the lower gripping portion 22 of the element is seen to have recesses 30 opening into the flange edges and the upper portion of the web has a square aperture 32 therein adjacent the upper ends of the side flanges 18. The upper portion 24 of the element 12 is seen to be inwardly offset from the lower portion 22 by means of a shoulder 34 and the lower ends of the flanges 18 have the edges 36 thereof acutely angled from their juncture with the web 20 to the point of their juncture with the gripping edges 38 of the element 12.

The second clamping element 14 is similar to the first clamping element 12 and comprises an elongate member having side flanges 40 interconnected by a web 42. The second element is narrower than the first element and nestingly interfits therewith as is more clearly apparent in FIGS. 2 through 4 of the drawings with side flanges 40 generally nesting within the side flanges 18 of element 12. Like element 12 the element 14 is divided into a lower gripping portion 44 and an upper portion 46 by means of a shoulder portion 48. Also, adjacent the juncture of the upper and lower portions 44 and 46 there are recesses 50 provided in the side flanges 40 which open into the edges thereof. At its upper end the clamping element 14 is provided with an inwardly extending projection 52. The edges 54 of the side flanges 40 along the lower gripping portion of the element 14 provide gripping edges and the lower ends of the side flanges have their edges 56 angled at an acute angle from their juncture with the web 42 to their juncture with the gripping edges 40. To complete the description of this element aperture 58 is provided in the upper portion thereof adjacent the upper end.

In the version of the clamp illustrated, the actuating means 16 for the clamp is seen to comprise a carriage bolt 60, the square head portion 62 of which seats within the square aperture 32 of the first element 12. Lock nut 64 can be provided to fixedly position the carriage bolt 60 with respect to element 12 so that in effect the carriage bolt constitutes a stud projecting from the inner surface of the web 20 of the element. The threaded end portion 66 of the carriage bolt passes loosely through the aperture 58 in element 14 and wing nut 68 threads on to the threaded end portion 66 thereby interconnecting the upper portion of the elements 12 and 14 to one another between the inwardly extending projection 52 of element 14 and the lower gripping portions of elements 12 and 14.

Figure 2:
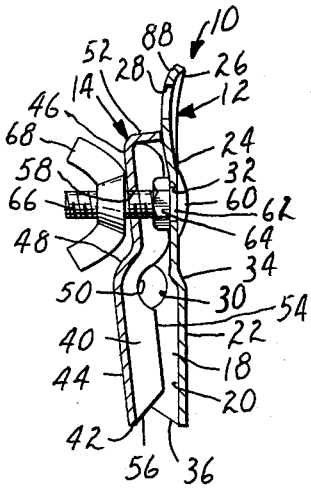
FIG. 2 is a cross-sectional view through the clamp of FIG. 1.

Turning to FIG. 2, the clamp 10 is in its rest position with the actuating means 16 holding the first and second elements 12 and 14, respectively, together with the end of the inwardly extending projection 52 at the upper end of the web 42 of element 14 abutting the floor of the web 20 of element 12. Wing nut 68 is tightened down and the recesses 30 and 50 in the elements 12 and 14, respectively, open into one another. The gripping edges 38 and 54 of the elements 12 and 14 overlap one another toward the lower ends.

Figure 3:
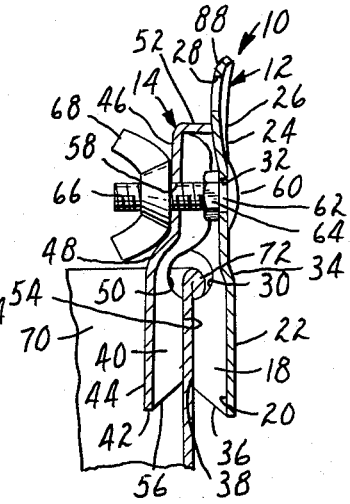
FIG. 3 is a cross-sectional view of the clamp of FIG. 1 shown gripping an object.

In FIG. 3 the clamp 10 is shown gripping an object in the form of a pail 70 with the gripping edges 38 and 50 of the side flanges 18 and 40 respectively of the elements 12 and 14 being generally parallel and tightly gripping the wall of the pail 70, the lip 72 of the pail seating within the recess formed by recesses 50 and 30.

The effective length of the inwardly directed projection 52 at the upper end of element 14 is such that as the gripping edges 38 and 50 of the elements 12 and 14 move from a spaced apart position toward a coplanar relationship tightening of the wing nut 68 causes them to approach a parallel relationship adjacent the point where the edges would be coplanar. Thus the abutment end of the inward projection 52 serves as a pivot point about which the gripping edges move toward one another as the wing nut 68 is tightened so that as they approach coplanarity a relatively even force is exerted against an object to be grasped between these gripping edges along the length of the gripping edges so that a tight secure gripping action results substantially along the entire length of the gripping surfaces thereby preventing damage to the item being gripped and enabling the small clamp to support quite heavy loads without exerting any undue pinching pressure at any one point on the item being held.

Figure 4:
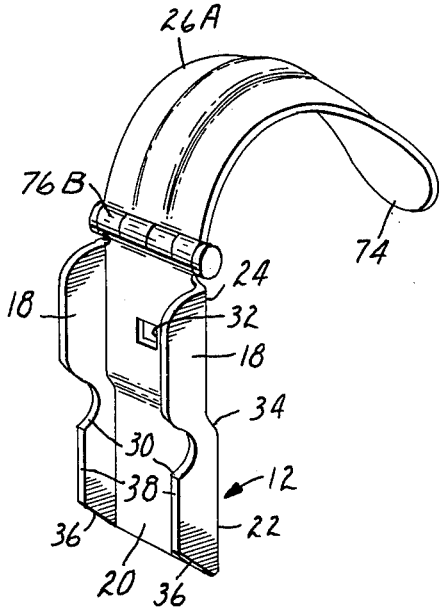
FIG. 4 is a perspective view of the clamp of FIG. 1 showing a modified form of suspending the clamp from the support.

FIG. 4 shows a modified clamping element 12 wherein the suspension means 26A comprises an extension of the web 20 in the form of a hook 74 for supporting the clamp 10 from a rail or the like. The hook is hingedly connected to the clamp body by the hinge 76B to allow swinging movement of a clamped object without disrupting the hook on its supporting rail.

Figure 5:
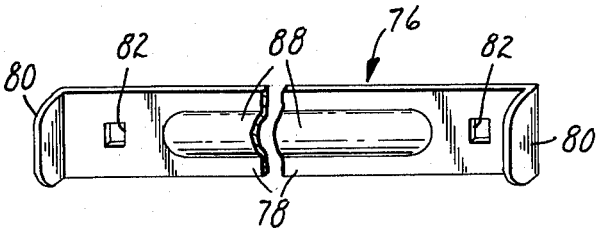
FIG. 5 is a perspective view of a bracket assembly comprising the clamps of this invention.

A bar 76 is shown in FIG. 5 for connecting a pair of the clamps 10 to one another and forming a bracket assembly. As will be noted the bar is simply an elongated member 78 having short end flanges 80 at each end parallel to one another and extending in the same direction generally perpendicular to the plane of the bar. Adjacent the end of the bar are square holes 82. The bar is for use with clamps 10 having either the hook suspension means 74 as shown in FIG. 4 or the simple apertured suspension means shown in FIGS. 1 through 3. The bar is attached to the clamps by the carriage bolts 60, which have the square head portions thereof passing through the apertures 82 and thence through the apertures 32 and 58 of the elements 12 and 14, thus fixing a clamp at each end of the bar. The inner wall of each of the flanges 80 of the bar 76 abuts the outer wall of the side flange 18 of element 12 when the clamps are mounted thereon as is more particularly illustrated in FIG. 6.

Figure 6:
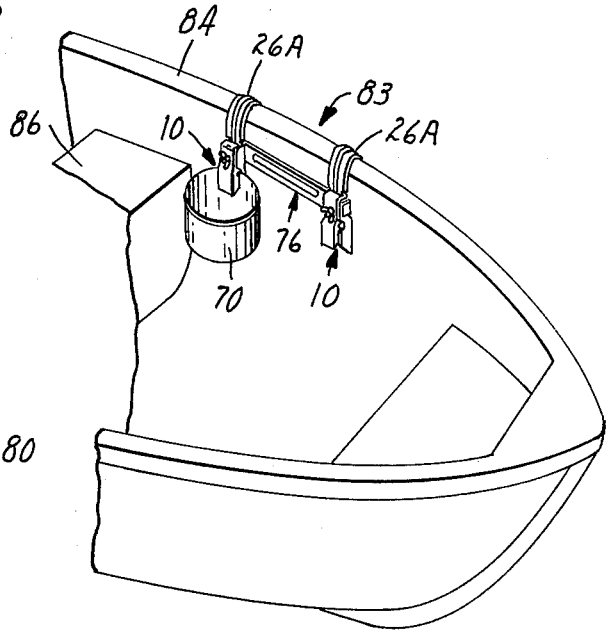
FIG. 6 is a perspective view of the suspension of the bracket assembly from the gunwales of the boat.

In FIG. 6 is illustrated a completed bracket assembly 83 comprising a bracket 76 having clamps 10 mounted on the ends thereof, each of the clamps 10 having a first clamping element 12 of the type shown in FIG. 4. The bracket 83 is shown suspended from the gunwales 84 of a small boat 86, a pail 70 being suspended from one of the clamps. This bracket assembly provides a very rigid type of structure which does not sway or swing because of the two point stability afforded.

In the preferred form of the clamp and clamping assembly of this invention just described, the flat stock forming the parts is shown as being ribbed as at 88 for reinforcing and stiffening. The shoulders inwardly offsetting the upper portions of the clamping elements provide an elegant device wherein there are minimal protrusions provided by the carriage bolt 60 and the wing nut 68 of fastening means 16. These sophistications are quite useful but not necessary for the actual operation of the clamp. Further, while the side flanges 18 and 40 are shown extending substantially the length of the clamping elements to strengthen them, for the operation of the clamp it is only necessary that they be extended throughout the gripping portion of the clamp. These and other modifications within the normal skill of the art can be made within the scope of the invention as defined in the appended claims.

I claim:

1. A clamp for gripping objects comprising first and second elongated clamping elements each having an upper portion and a lower gripping portion and including generally parallel side flanges interconnected by a web, said side flanges extending at least along the lower gripping portion of each element, said second element being narrower than said first element and interfitting therewith such that the side flanges thereof next between the side flanges of said first element, the edges of said side flanges on the lower portions of said elements comprising the gripping surfaces for said clamp, the upper end of said first element extending above the upper end of said second element; the upper end of the web of the second element having an inwardly extending projection abutting the upper portion of the web of said first element, and actuating means for opening and closing said clamp interconnecting the upper portions of said elements to one another between said projection and the lower gripping portions of said elements, said projection maintaining the gripping edges of said side flanges along the lower gripping portions of said clamping elements generally parallel to one another as they approach coplanarity as the clamp elements are moved from an open spaced apart object receiving position to be closed object gripping section thereby enabling such gripping edges of the clamp elements to tightly grip an object therebetween while exerting relatively even pressure along the gripping length of the flange edges.

2. The clamp of claim 1, said actuating means comprising a stud projecting from the web of the upper portion of said first clamp element and passing through an aperture in the web of the upper portion of said second clamp element and including means interengaging the portion of said stud extending through said aperture and the outer surface of the upper web portion of said second element.

3. The clamp of claim 2, the lower ends of said clamping elements being generally coterminal, the lower end edges of said side flanges of said clamping elements being acutely angled from their junctures with the webs of said elements to the point of their juncture with the gripping edges of said side flanges to facilitate insertion of an object to be gripped between said clamping elements.

4. The clamp of claim 3, said side flanges of said clamping elements being coextensive along substantially the entire length of said second clamping element.

5. The clamp of claim 4, said flanges having opposing recesses opening into the gripping edges thereof to receive the lip of a container or the like.

6. The clamp of claim 1, the upper end portion of said first element extending beyond the upper end of said second element and including means for suspending said clamp from a support.

7. The clamp of claim 6, said suspending means comprising a hook.

8. The clamp of claim 6, said upper portions of said clamping elements being inwardly offset from the lower portions thereof.

9. A clamping assembly comprising a pair of clamps and an interconnecting bar, each of said clamps comprising a pair of elongated nesting channel shaped elements comprising side flanges interconnected by a web actuating means joining the channel elements of each pair of one another to move said elements toward and away from their nesting relation with one another to receive, grip and release an object to be clamped between the opposing edges of the side flanges of each element, said actuating means attaching each clamp to one end of said interconnecting bar, said bar having a flange at each end thereof abutting the side wall of each clamp, the upper portion of one of the clamping elements of each clamp extending above said interconnecting bar and comprising means to suspend said assembly from a support.

10. A clamp for gripping objects comprising a pair of clamping members having upper and lower portions, actuating means interconnecting the upper portions of said members for movement between object receiving and object gripping positions, the lower portions of said clamp members being channel shaped, each including a web and generally parallel side flanges, one of the members being narrower than the other and the webs of the members being in facing relation to one another with the flanges of the narrower adapted to fit between the flanges of the other, one of said members having an inwardly extending projection adjacent the upper end thereof and above the actuating means, the effective length of said projection being such as to maintain the gripping edges of said flanges of each member generally parallel to the gripping edges of the other member as such gripping edges approach coplanarity as they are moved toward one another by said actuating means.

11. The clamp of claim 10 wherein a hook for suspending the clamp from a support is swingably connected to the upper end of one of said clamping members.

* * * * *